US006899481B2

(12) United States Patent
Katsandres et al.

(10) Patent No.: US 6,899,481 B2
(45) Date of Patent: May 31, 2005

(54) RETRACTABLE BELT LOTION APPLICATOR

(76) Inventors: Steve D. Katsandres, 2833 NW. 73rd St., Seattle, WA (US) 98117; Fred S. Benz, 942 NW. 64th St., Seattle, WA (US) 98107

( * ) Notice: Subject to any disclaimer, the term of this patent is extended or adjusted under 35 U.S.C. 154(b) by 0 days.

(21) Appl. No.: 10/692,279

(22) Filed: Oct. 22, 2003

(65) Prior Publication Data

US 2004/0161281 A1 Aug. 19, 2004

Related U.S. Application Data

(63) Continuation-in-part of application No. 10/007,542, filed on Dec. 10, 2001, now abandoned.

(51) Int. Cl.[7] ..... A46B 5/02

(52) U.S. Cl. ..... 401/6; 401/8; 401/99; 15/222

(58) Field of Search ..... 401/6–8, 99, 109; 239/48; 15/222, 230.13

(56) References Cited

U.S. PATENT DOCUMENTS 5,013,171 A * 5/1991 Almond, II ..... 401/6

* cited by examiner

*Primary Examiner*—Gregory L. Huson
*Assistant Examiner*—Peter deVore
(74) *Attorney, Agent, or Firm*—Stratton Ballew PLLC

(57) ABSTRACT

A belted applicator for applying a lotion substance, and more particularly a lotion applicator having a retractable belt in a handled configuration that lends to the easy use of the device. The belted applicator includes two handled housing bodies interconnected by a belt. The belted applicator may also include disposable belt cartridges, which include a lotion, or any other substance applied with the belted device. The lotion may be a liquid, a gel, or a powder in a medicinal, massage, moisturizer insect repellent or sunscreen formulation. The belted applicator has leak resistant features that also reduce dripping of lotion from the belt. The belt may feed in sequence, when depleted, with the depleted portion of the belt removed by the user. The belted applicator may also include two interlocked portions that serve to seal the belt within and communicate lotion between the two interlocked portions.

9 Claims, 11 Drawing Sheets

RETRACTABLE BELT LOTION APPLICATOR

TECHNICAL FIELD

The invention relates to a method and apparatus for a belted applicator, and more particularly to a lotion applicator having handles and a retractable belt, the applicator also including leak resistant features. The applicator additionally provides optional replaceable belts in a cartridge.

BACKGROUND OF THE INVENTION

The applications of lotions onto hard to reach areas of the body is sometimes required. For example, sunscreen must be applied evenly and to all exposed skin. Without complete coverage, painful, unhealthy and likely embarrassing sunburns may result. Moisturizing creams, arthritis balms and muscle rubs are examples of lotions that typically are applied on hard to reach areas of the back, neck and shoulders.

Additionally, light abrasion is desirable in the application of certain lotions. Rough materials, such as "luffa pads" are often employed to remove dirt, oils and dead skin. Belted pads have been utilized to give a user the leverage and reach for rubbing areas of the body that can not be reached by simple, hand held pads.

Improvements to belted lotion applicators are shown in U.S. Pat. No. 5,013,171, which discloses a body lotion applicator apparatus having two handles and a retractable belt connecting the two handles. Though an improvement over prior belted lotion applicators, the device is cumbersome to use, especially when a user employs the device to rub their lower back and shoulder areas. The configuration of the apparatus required a user to perform contortions to sue the device. Additionally, the device is messy and tends to drip and leak the lotions contained within.

A belted lotion applicator is needed that is more ergonomic and easier to use. Such an improved device must be designed to provide a user with an easily adjustable and positionable access to hard to reach areas of the body. Also, the belted applicator must resist unwanted leaking and dripping, especially when in use.

The present invention, described below, meets these requirements and will be understood by reference to the following detailed description taken in conjunction with the accompanying drawings.

DETAILED DESCRIPTION OF SPECIFIC EMBODIMENTS

The invention provides a retractable belt applicator device, and more particularly a belted applicator having a retractable belt in a handled configuration that lends to the easy use of the device. The belted applicator may also include disposable cartridges of a lotion, or any other substance applied with the device.

Preferred embodiments of the present invention are shown in FIGS. 1 through 11. The belted applicator 30 includes a belt 33 that is retractable. The retractable belt 33 dispenses a lotion 34. For the present invention, the lotion may be any type of cream, salve, perfume, medicine, insect repellent, or balm that has a flowable constancy and absorbable into the retractable belt, for the purpose of application by the belt.

Figure 6:
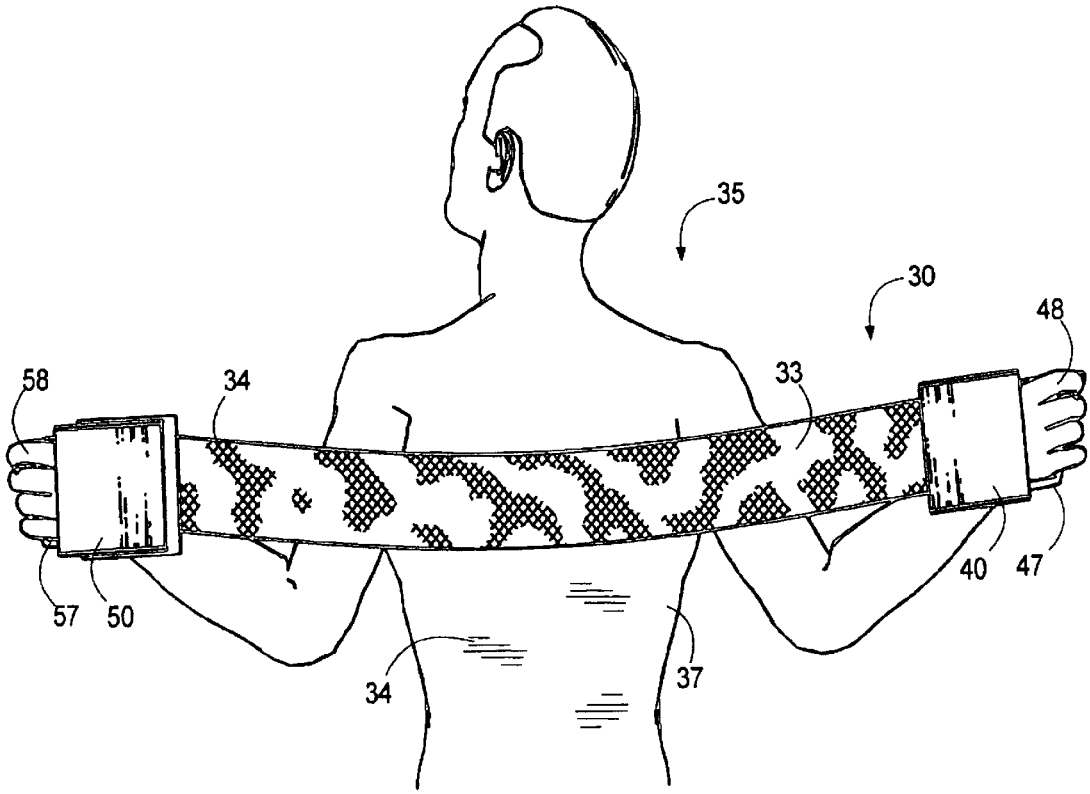
FIG. 6 is a perspective view of a belted applicator in use, according to an embodiment of the invention.

The belted applicator 30 is portable, hand held and can be made of an injection molded plastic, as preferred, or any other appropriate material generally known for use in the manufacture of a hard shelled housing. Additionally, the belted applicator 30 can be made in any color. Because if its small size and simple, smooth exterior, the belted applicator is washable and easily stored. With the belted applicator, a user 35 is able to position the belt 33 on hard to reach parts of the user's body, including the back 37 of the user, as shown in FIG. 6, where the belted applicator can deliver a measured quantity of the lotion 34, and additionally massage, rub, exfoliate and abrade the user.

Figure 11:
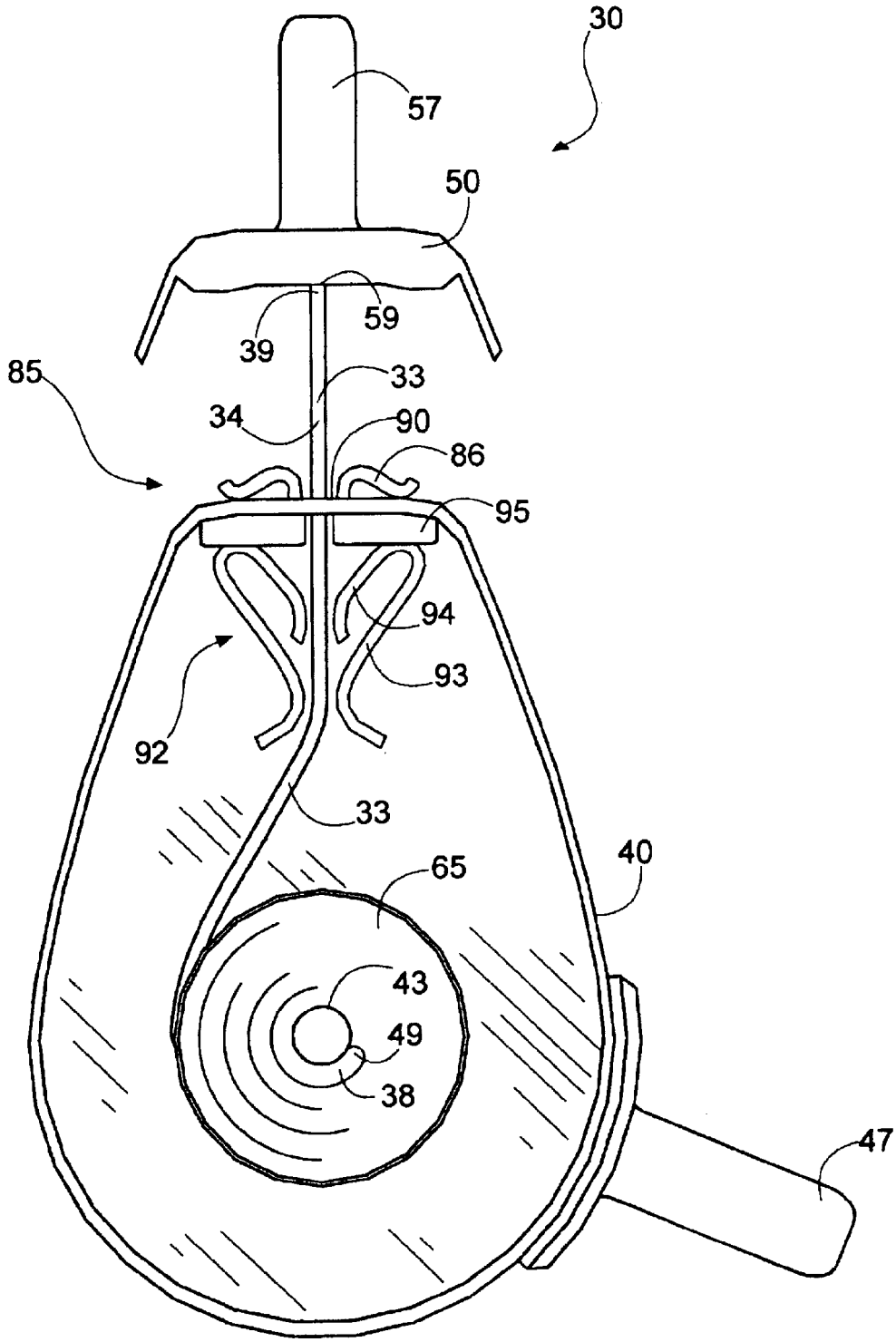
FIG. 11 is a side view of a belted applicator, according to an embodiment of the invention.

The belt 33 of the belted applicator 30 has a first belt end 38 and a second belt end 39, as shown in FIG. 11. The belted applicator 30 of the present invention includes at least a first handled body 40, that encases or houses a first cavity 41. The first belt end is attached to the first handled body at a first belt attachment 49. This first belt attachment is preferably temporary, to allow the replacement of the belt. The first handled body encloses the belt 33, when retracted into the first cavity. The first cavity includes a first retraction mechanism 43 for maintaining a winding tension on the belt.

The first handled body 40 also includes a first handle 47. The first handle extends from the first handled body and allows the user to grasp the handled portion without grasping the remaining body of the device. The first handle is preferably a simple, conventional pistol grip, or alternatively a shovel type of handle. Most preferably, the first handle provides for easy rotation of the first handled body around a first hand 48 of the user 35. The first handle can alternatively include rings for the user's fingers, or alternatively a strap for attachment to the first hand of the user.

Figure 3:
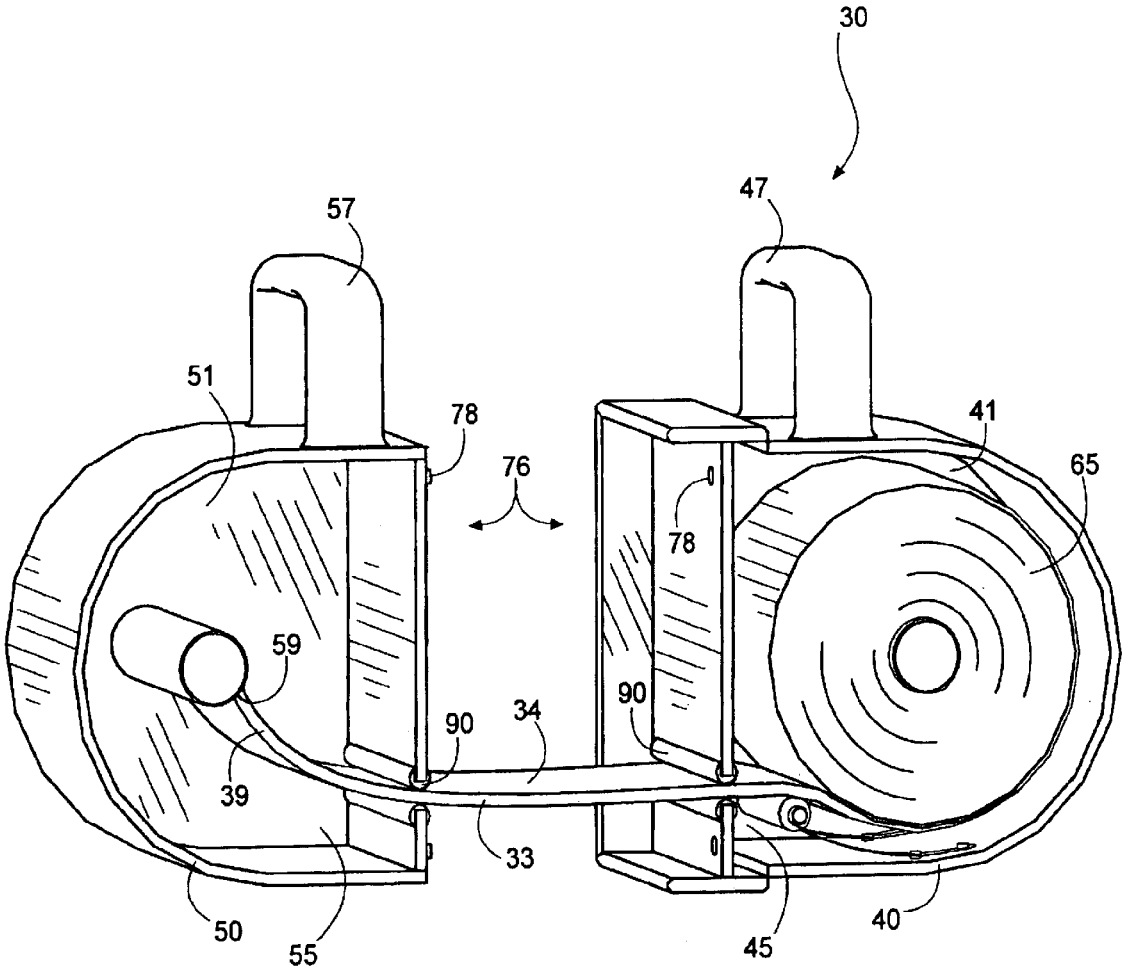
FIG. 3 is a perspective view of a belted applicator, according to an embodiment of the invention.
Figure 4:
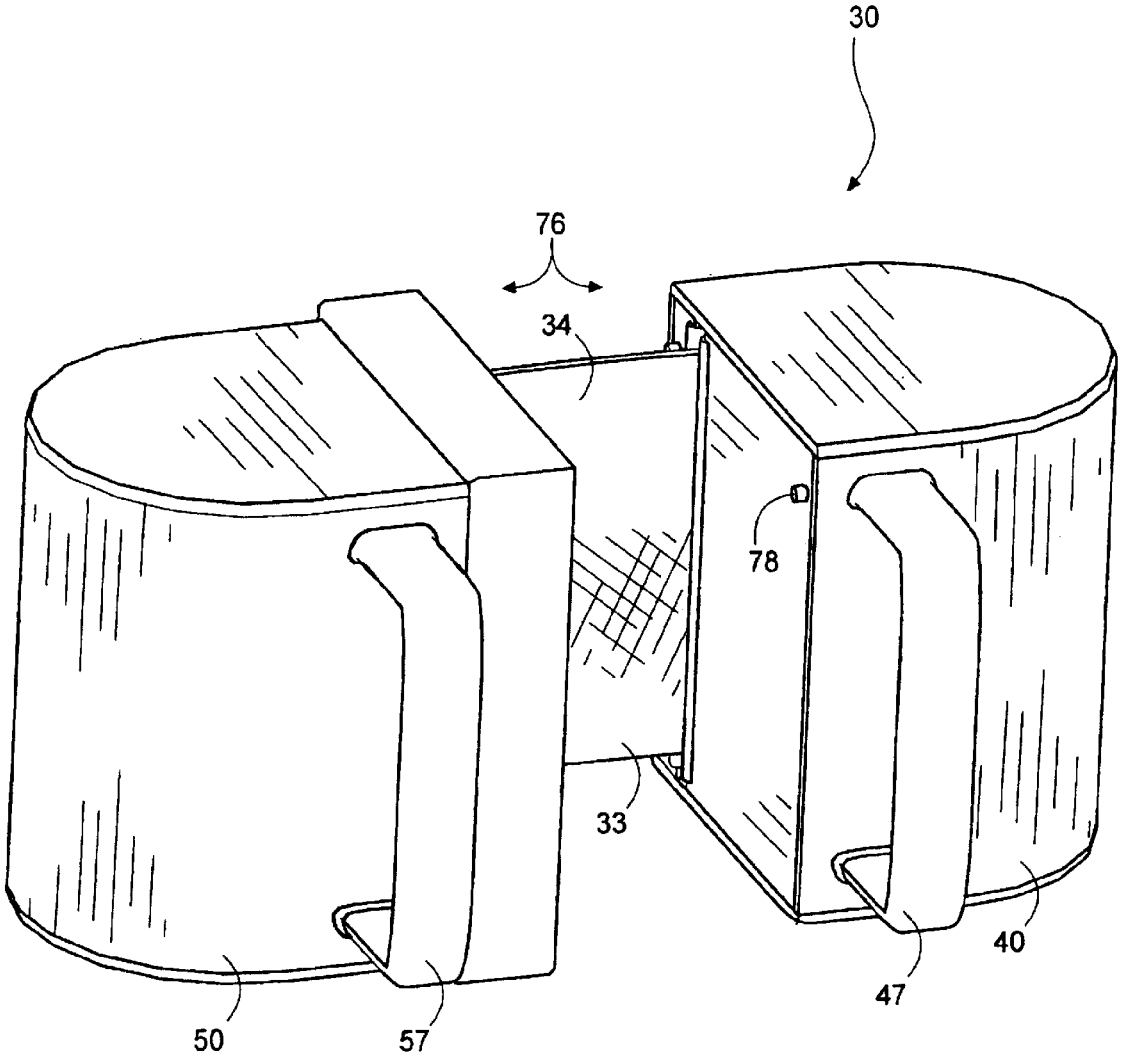
FIG. 4 is a perspective view of a belted applicator, according to an embodiment of the invention.
Figure 5:
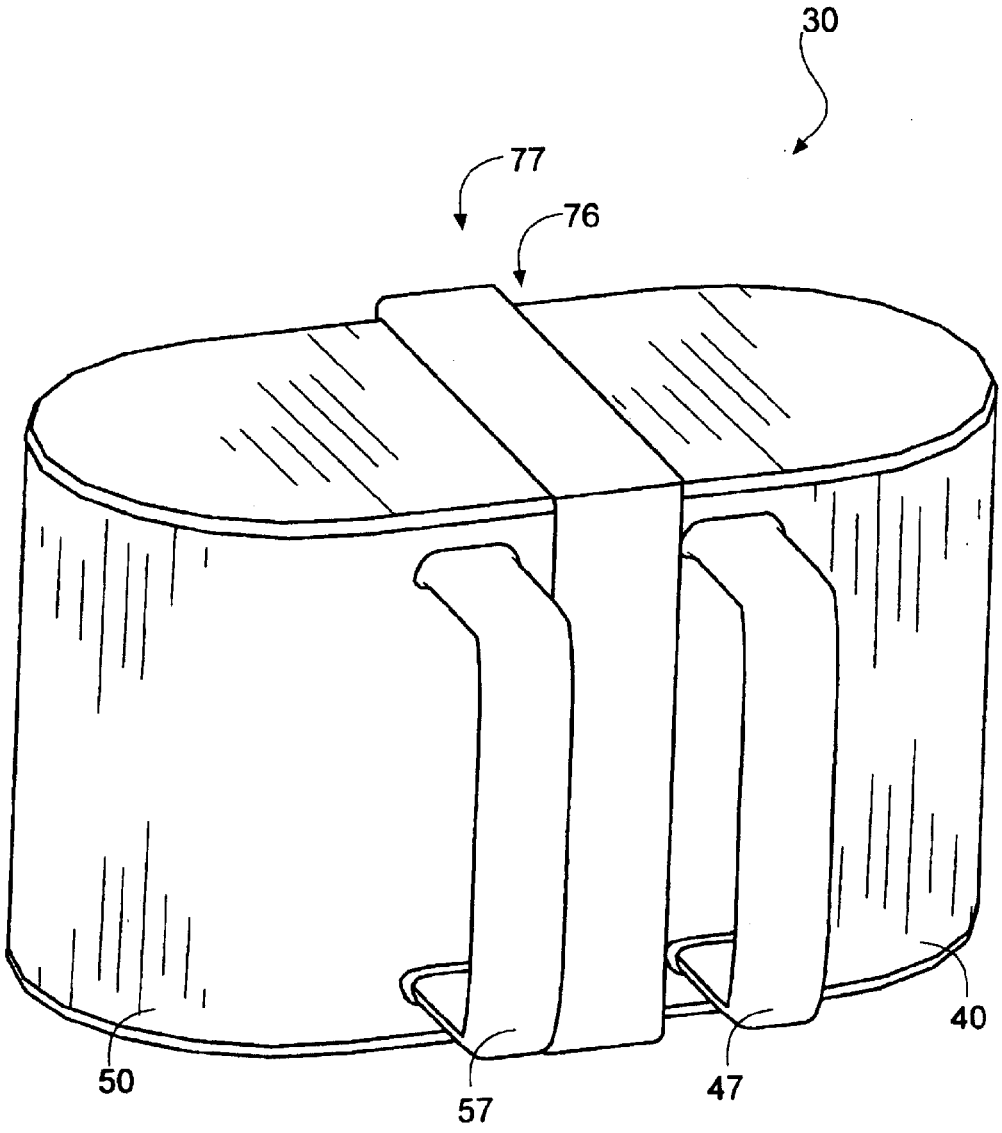
FIG. 5 is a perspective view of a belted applicator, according to an embodiment of the invention.

In a preferred embodiment, the belted applicator 30 of the present invention includes a second handled body 50, attached to the second belt end 39. As shown in FIG. 3, the second handled body may encases a second cavity 51. The second belt end is attached to the second handled body. The first handled body encloses or houses the belt 33, when retracted into the second cavity. The second handled cavity can include a second retraction mechanism 53, which can be employed to advance the belt, as the belt becomes depleted of lotion, soiled, frayed, blocked or otherwise worn out.

The second handled body 50 also includes a second handle 57. Like the first handle 47, the second handle is preferably a simple, conventional pistol grip, or alternatively a shovel type of handle. Most preferably, the second handle provides for easy rotation of the second handled body around a second hand 58 of the user 35. The second handle can alternatively include rings for fingers, or a strap for attachment to the second hand of the user.

Figure 7:
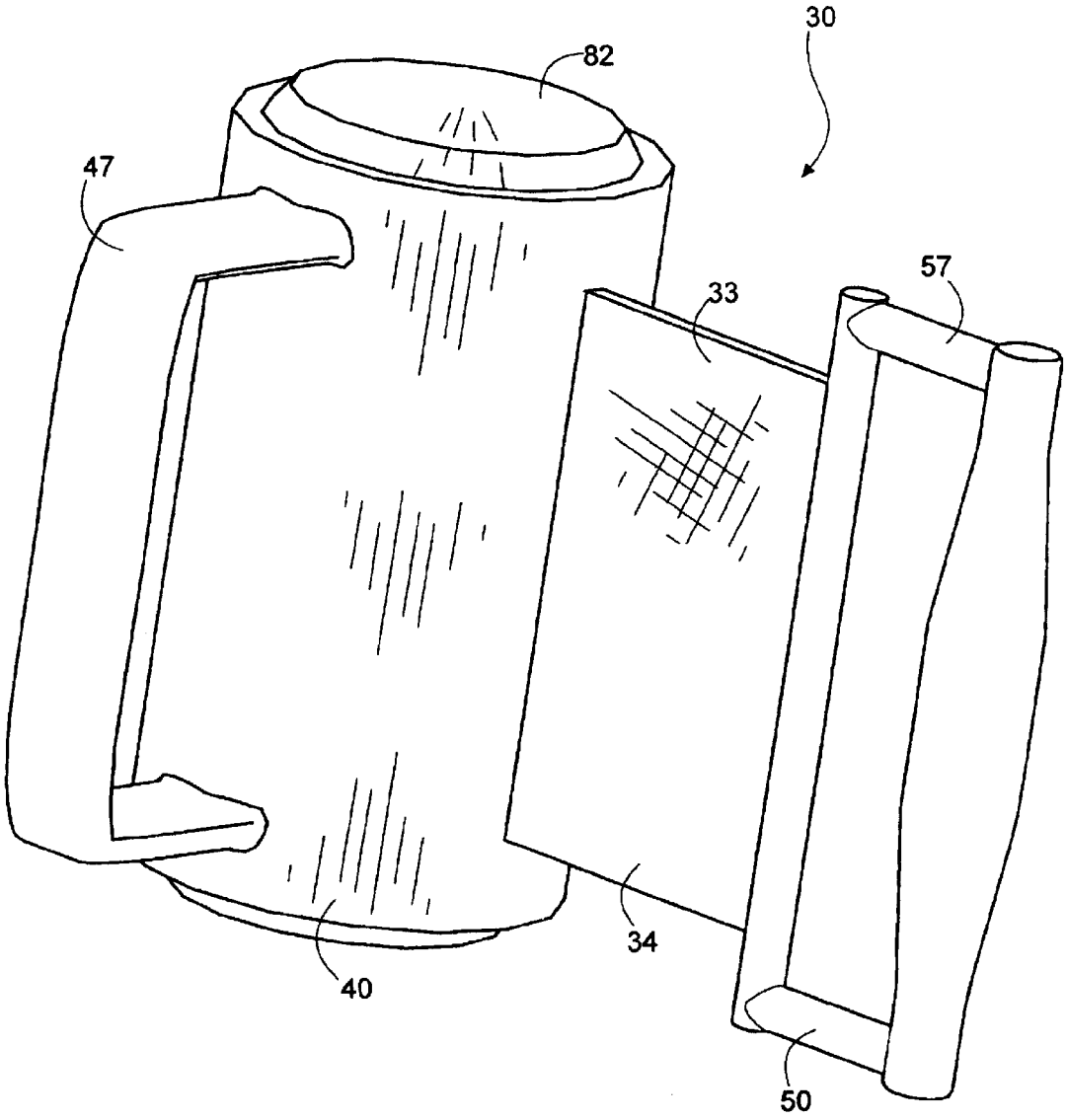
FIG. 7 is a perspective view of a belted applicator, according to an embodiment of the invention.
Figure 9:
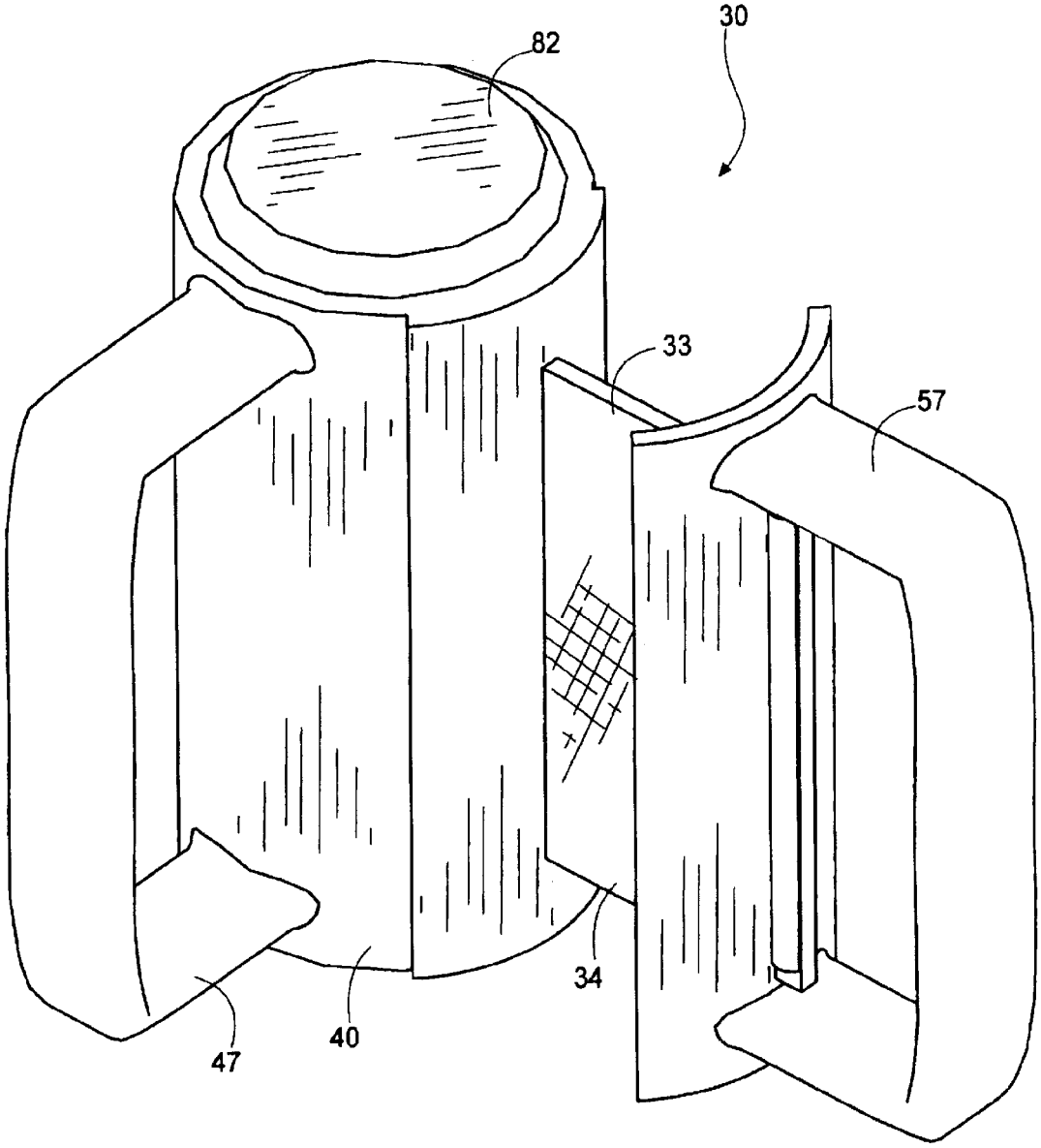
FIG. 9 is a perspective view of a belted applicator, according to an embodiment of the invention.
Figure 10:
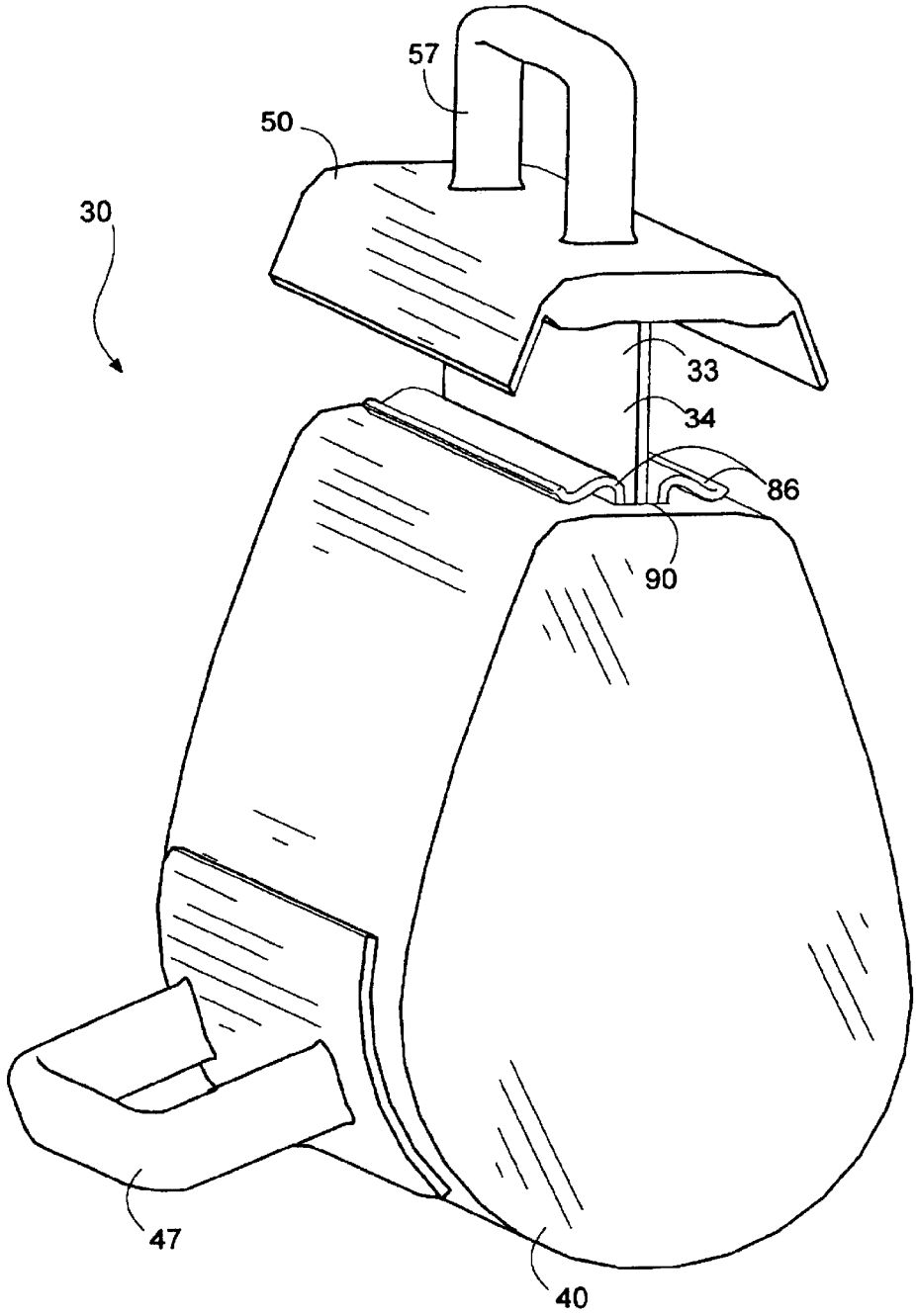
FIG. 10 is a perspective view of a belted applicator, according to an embodiment of the invention.

In a preferred alternative embodiment of the present invention, as shown in FIGS. 7, 9, and 10, the second handled body 50 may only include the second handle 57 with a second belt attachment 59 for clasping the second belt end 39. The second belt attachment may be removable, to disengage from the second belt end. The user 35 may unclasp or disengage the second belt attachment from the second belt end and cut off and discard an unwanted segment of the belt 33. The user may then reattach the second belt attachment to the new second belt end and continue using the belted applicator. Additional belt material can be stored and spooled from the first handled body, as needed.

In a most preferred embodiment of the present invention, the belted applicator includes a belt cartridge 65, as shown in FIG. 3. The belt cartridge is most preferably the belt wound upon a spool 66. For this preferred embodiment, the spool includes the first belt attachment 49 and so receives the first belt end 38. The spooled belt of the belt cartridge is preferably saturated or pre-charged with the lotion. To install, the belt cartridge can be placed into the first cavity of the first handled body 40, and the second belt end 39 fed to the second belt attachment of the second handled body 50.

The first handled body 40 and the second handled body 50 of the belted applicator 30 can be constructed from various materials, such as metals, plastics, ceramics or composites. Additionally, as an alternative, the belted applicator may include an auxiliary strap for attachment to the waist or leg of the user 35, or to a bicycle, pack or any such item, for easy accessibility.

The belt 33 of the belted applicator 30 is preferably absorbent and strong. The absorbent belt dispenses the lotion 34, which, as discussed above, broadly includes any liquid material desired. Preferably, the belt is removable and washable, or disposable as an alternative. The belt may comprise various absorbent materials, in varying lengths, thickness, and widths limited only by the shape and capacity of the belted applicator. Essentially, the belt is used to apply, dispense, and affect the application of the lotion to skin areas, such as the back, shoulders, arms, and legs.

Again, the belt 33 can be any combination of materials from absorbent and stretchable, to abrasive. The belt can be in a variety of forms and composites such as strapping, webbing, cloth, sponge, foam, paper based or other specialty belting fabrics. As an option, the belt can be dispensed from the belt cartridge 65, discussed above. Alternatively, the belt can be reusable, with the first belt end 38 retractable after extension by the first retraction mechanism 43.

For the first retraction mechanism 43, and as an additional alternative, for the second retraction mechanism 53, the belted applicator 30 can employ any one of several alternative retraction mechanisms. Such conventional mechanisms include retractable spiral-power springs, or an arbor shaft to which the belt 33 can be attached. The retractable spiral-power springs, or more generally the retraction mechanism, will preferably have a varying retraction tension that is dependent upon the belt material and substances used. Preferably, retraction mechanism of the belted applicator is spiral spring loaded and self retractable, able to accommodate or incorporate the variety of belts discussed above. Alternatively, the belt can be manually retractable, with a conventional crank or knob.

A spring mechanism that would be well suited for use as the first retraction mechanism 43, or the second retraction mechanism 53, is disclosed in U.S. Pat. No. 5,013,171. However, for the present invention, the additional and novel feature of advancing the belt to reel out new material or the use of the belt cartridge 65, requires the use of retraction mechanisms not employed previously for prior devices with a similar general function of the belted applicator 30.

As discussed above, the first cavity 41 of the first handled body includes a first reservoir 45. The first reservoir receives the lotion 34. Optionally, the second cavity 51 of the second handled body may includes a second reservoir 55, as shown in FIGS. 1 through 5. The second reservoir may also receive the lotion 34, within. The lotion reservoirs are preferably refillable, washable and with few working and easy to maintain parts. Alternatively, the belted applicator may be a sealed with the entire belt applicator 30 being disposable.

Figure 8:
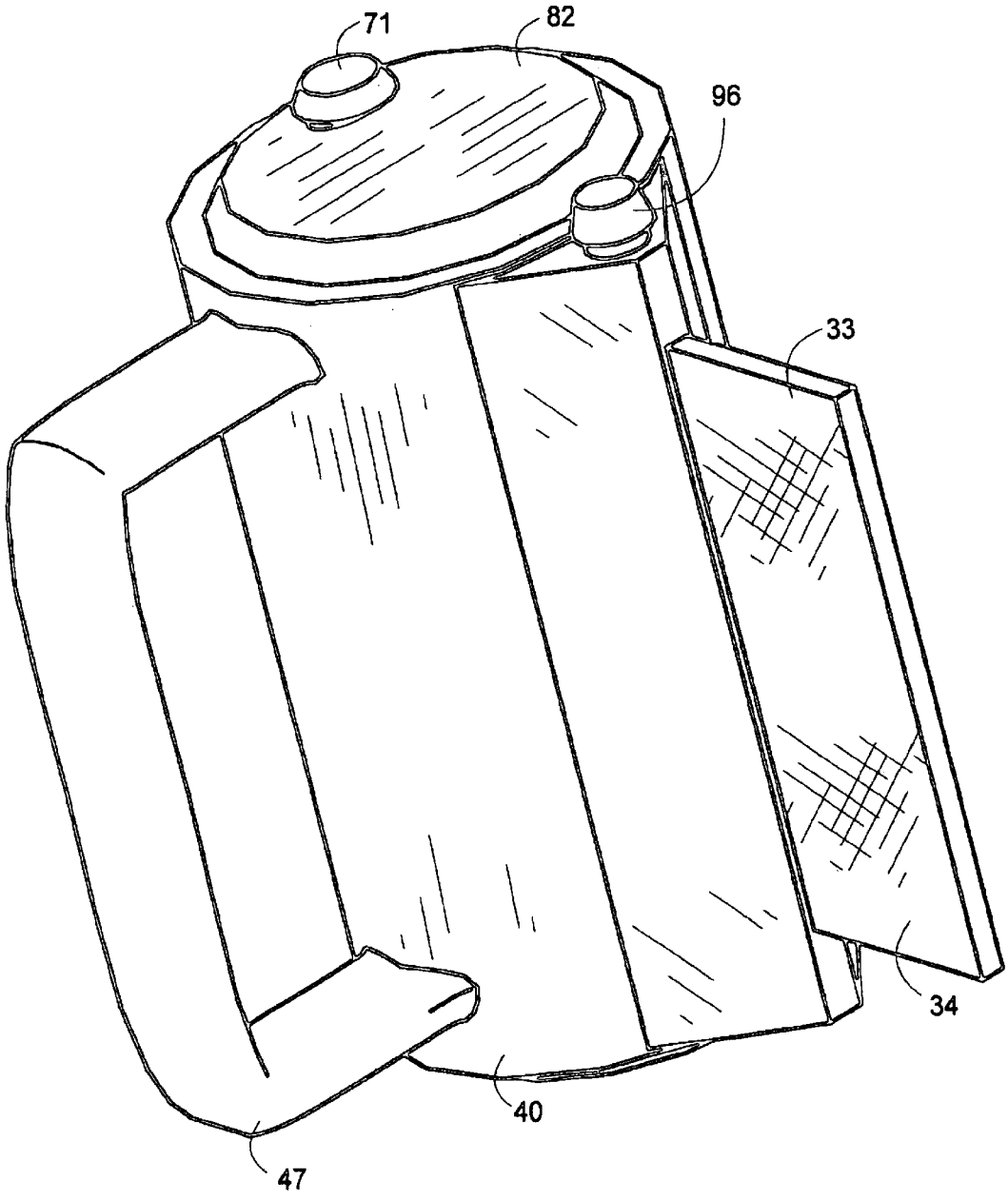
FIG. 8 is a partial perspective view of a belted applicator, according to an embodiment of the invention.

In an alternative preferred embodiment of the present invention, the belted applicator 30 includes a lotion filling port 71, as shown in FIG. 8. The lotion filling port opens into the first reservoir 45 of the first handled body 40. As the belt 33 is dispensed, it withdraws lotion from the first reservoir. Alternatively, if the embodiment includes the second handled body 50, the second handled body may also include a similar lotion filling port for adding lotion into the second reservoir 55. As the belt 33 is dispensed from the second handled body, it withdraws lotion from the second reservoir.

In an additional preferred alternative embodiment of the present invention, the belt applicator 30 can include a housing interlock 76. The housing interlock connects the first handled body 40 to the second handled body 50, forming a sealed housing unit 77. For this interlocked embodiment, a reservoir pass through 78 can also be employed as an additional feature. The first reservoir can be connected to the second reservoir with the reservoir pass through, to allow the lotion to flow between the reservoirs, when the belted applicator is interlocked.

Additionally, the first handle 47 and the second handle 57 may be utilized as part of the respective first reservoir 45 and the second reservoir 55, and so store the lotion 34. The first handle and second handle are multi-functional, with one or both smaller for portability, or larger to employ storage of applied lotions, keys, money, or other valuables.

Figure 1:
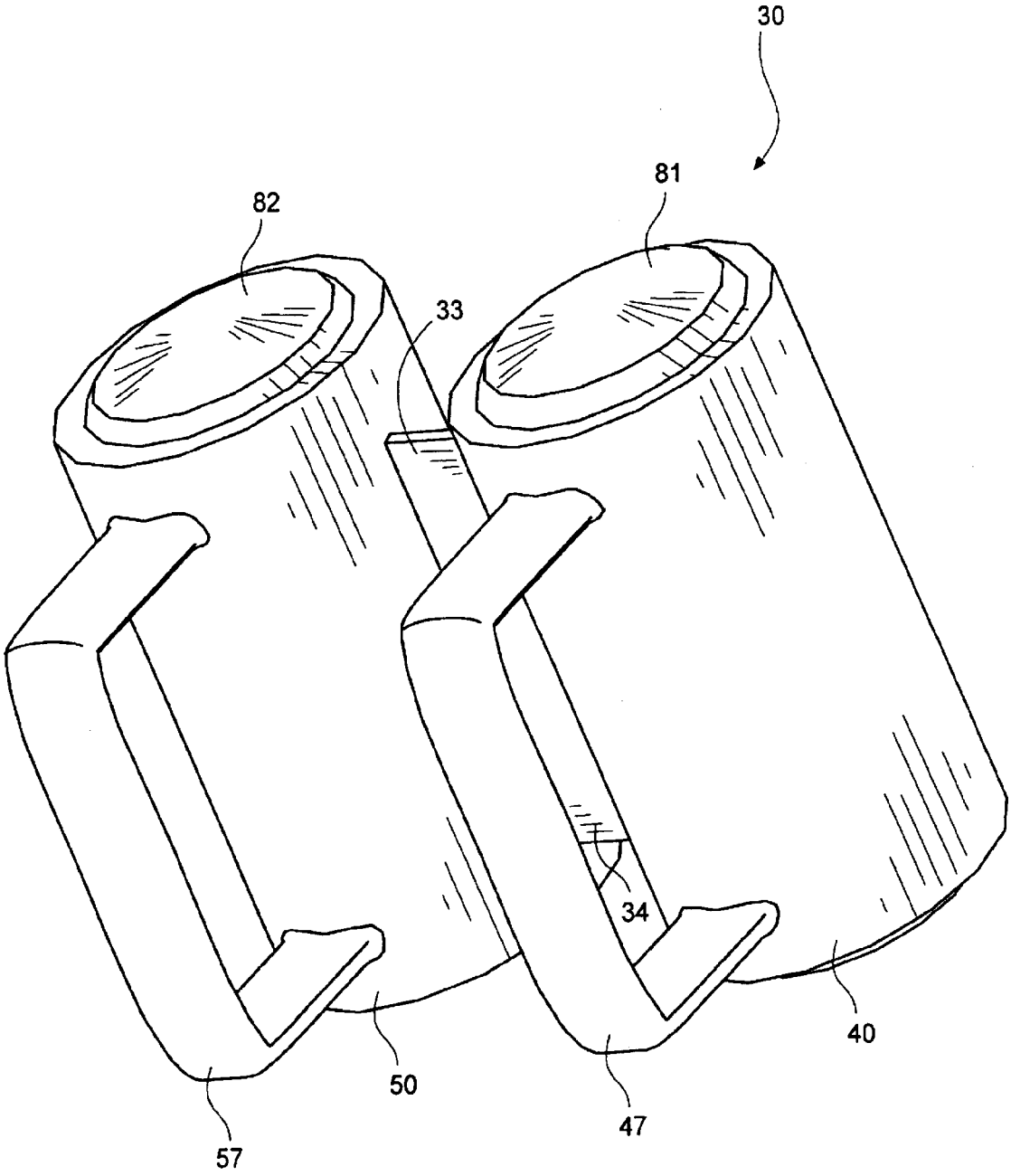
FIG. 1 is a perspective view of a belted applicator, according to an embodiment of the invention.
Figure 2:
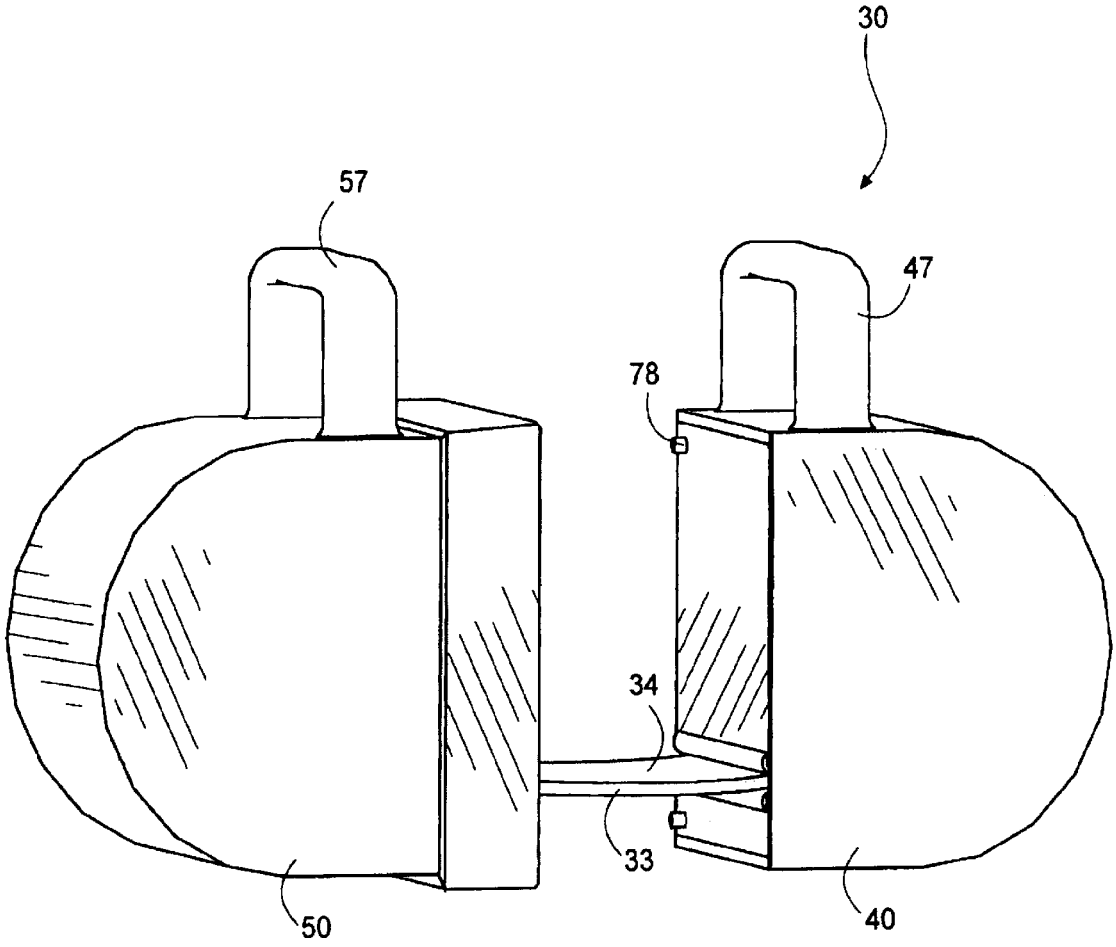
FIG. 2 is a perspective view of a belted applicator, according to an embodiment of the invention.

For a preferred embodiment of the present invention, the first handled body 40 can include a first housing cap 81, as shown in FIG. 1. Similarly, the second handled body 50 can include a second housing cap 82. The housing caps are removable to allow access into the respective first cavity 41 or the second cavity 51. The housing caps may be threaded, slidable, hinged, or compression fitted to the respective handled housings.

When either, or both the first handled body 40 and the second handled body 50 are utilized to contain and meter the lotion 34 for use with the belt 33, a system of seals 85 is preferably employed, as shown in FIG. 11. The seal system is required to minimize leakage of the lotion, and to wring out or squeeze excess lotion from the belt as the belt is dispensed.

As shown in FIG. 11 for a preferred embodiment of the belted applicator 30 having the first handled body 40 that receives the belt 33, the system of seals 85 includes an outer seal pair 86, preferably located on the first handled body. The belt enters the first handled body though a belt slit 90. The outer seal pair is most preferably parallel to the belt slit. The belt then passes through an inner seal 92, which is positioned within the first reservoir 45 of the first handled housing.

Preferably, the inner seal 92 includes a multiple of seals, all parallel to the belt slit 90, as with the outer seal. Most preferably, the inner seal includes a primary inner seal 93 and a secondary inner seal 94, employed to guide the belt 33 into and out from the belt slit, and to provide for the removal of excess lotion 34 from the saturated belt.

The primary inner seal 93 extends into the first reservoir 45, and the secondary inner seal 94 is positioned parallel to the primary seal on the belt 33, but closer to the belt slit 90 than the primary seal. Preferably, the secondary inner seal grasps the belt more tightly than the primary seal, to provide even greater squeezing of excess lotion 34 from the belt. The system of seals 85 most preferably run the entire length of the belt slit, and each of the seals are formed of a smooth, stiff plastic, or alternatively a thin metal strip.

In a preferred alternative of the present invention, a slit guard 95 at the belt slit 90, as shown in FIG. 11, can be tightened or loosened to accommodate varying thicknesses of the belt 33. An adjustment knob 96 for the slit guard is shown in FIG. 8.

As shown in FIG. 6, the belted applicator 30 can administer measured amounts of the lotion 34 to the back 37 of the user 35. A unique motion is used to manipulate the device into proper positioning for application of lotions. In this preferred method, the present invention is employed in a "back service method." For the back service method, the user grasps the first handle 47 of the first handled body 40 with the first hand 48 and grasps the second handle 57 of the second handled body 50 with the second hand 58. Most preferably, this grasping is accomplished with the backs of the user hands facing each other. The user then lifts the belted applicator by the first and second handles, inverting and rotating the belted applicator up and over the user's head, and then down over the user's back, while simultaneously extending the belt 33 by pulling the second handled body away from the first handled body, as shown in FIG. 6. This overhead motion, to place the belted applicator in the back service is similar to the conventional motion of a jump rope, which is flipped from the front side of the user, upward and over head, to the backside of the user.

After positioning the belted applicator 30 for the above described back service, the user 35 may glide the belt 33 of the belted applicator from side to side, with the arms moving together in unison. Alternately, the user may hold either hand stationary while moving the other arm side to side. In this alternative, single arm motion, the belt is sequentially extended and then retracted, which adds lotion 34 to the belt. Most preferably, a combination of the two techniques, with arms acting in unison and then in the single arm motion, are utilized in the back service method. The belted applicator, positioned over the forearms of the user, as shown in FIG. 6, is able to service the entire back side of the user, from the neck and shoulders to the lower back and legs.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A retractable belt lotion applicator comprising:

a first handled body, the first handled body having a first handle, the first handle for providing a user's first grip;

a belt, the belt having a first belt end and a second belt end, the first belt end attached proximate to the first handled body;

a second handled body, the second belt end attached proximate to the second handled body, the second handle for providing a user's second grip;

a first cavity within the first handled body;

a first retraction mechanism contained within in the first cavity, the first retraction mechanism for retracting the belt within the first handled body; and the second handled body includes a second retraction mechanism within the second housing body interior, and the second retraction mechanism for retracting the belt within the second handled body.

2. A retractable belt lotion applicator comprising:

a first belt housing body, a first handle attached to the exterior if the first belt housing body, the first handle for providing a first grip, the first grip separate from the first belt housing body;

a second handle attached to the exterior of the second belt housing body, the second handle for providing a second grip, the second grip separate from the second belt housing body;

a belt, the belt having a fist belt end and a second belt end, the first belt end attached proximate to the first belt housing body, and the second belt end attached proximate to the second belt housing body;

a first belt housing body interior within the first belt housing body;

a first retraction mechanism contained within in the first belt housing body interior, the first retraction mechanism including a first belt spool, and the first retraction mechanism for retracting the first belt within the first belt housing body;

a second belt housing body interior within the second belt housing body; and a second retraction mechanism contained within in the second belt housing body interior, the second retraction mechanism including a second belt spool, and the second retraction mechanism for retracting the second belt within the second belt housing body.

3. The retractable belt lotion applicator of the claim 2, wherein the belt is contained within a cartridge, and the cartridge is receivable into the first belt housing body, and the cartridge is replicable by a user.

4. A retractable belt lotion applicator comprising:

a first handled body and a second handled body, the first handled body including a first body interior;

a belt, the belt having a first belt end and a second belt end the first belt end attached to the first handled body and the second belt end attached to the second handled body;

the first handled body including a first retractable belting assembly in the first handled body interior, the first retractable belting assembly for retracting the belt within the first handled body;

a first end cap positioned on the first handled body, the first end cap removable for access into the interior of the first handled body;

a first replaceable cartridge receivable into the first handled body, the first replaceable cartridge containing a first lotion, the first replaceable cartridge replaceable into the first handled body by removing the first end cap; and the second handled body includes a second retractable belting assembly in the second handled body interior, and the second retractable belting assembly for retracting the belt within the second handled body.

5. A retractable belt lotion applicator comprising:

a first handled body and a second handled body, the first handled body including a first body interior;

a belt, the belt having a first belt end and a second belt end, the first belt end attached to the first handled body and the second belt end attached to the second handled body;

the first handled body including a first retractable belting assembly in the first handled body interior, the first retractable belting assembly for retracting the belt within the first handled body;

a first end cap positioned on the first handled body, the first end cap removable for access into the interior of the first handled body;

a first replaceable cartridge receivable into the first handled body, the first replaceable cartridge containing a first lotion, the first replaceable cartridge replaceable into the first handled body by removing the first end cap; and a second replaceable cartridge receivable into the second handled body, the second replaceable cartridge containing a second lotion, the second replaceable cartridge replaceable into the second handled body by removing the second end cap.

6. The retractable belt lotion applicator of the claim 5, wherein:

the first handled body interlocks with the second handled body to provide for the transfer of the first lotion into the second handled body.

7. The retractable belt lotion applicator of the claim 5, wherein:

the first handled body interlocks with the second handled body to provide for the transfer of the second lotion into the first handled body.

8. The retractable belt lotion applicator of the claim 4, wherein:

the first handled body interlocks with the second handled body to provide for the transfer of the first lotion into the second handled body.

9. The retractable belt lotion applicator of the claim 4, wherein:

the first handled body interlocks with the second handled body to provide for the transfer of the second lotion into the first handled body.

* * * * *